US009127912B2

(12) United States Patent
Billings

(10) Patent No.: US 9,127,912 B2
(45) Date of Patent: Sep. 8, 2015

(54) RIFLE SCOPE

(71) Applicant: Chris Lee Billings, Morgan, UT (US)

(72) Inventor: Chris Lee Billings, Morgan, UT (US)

( * ) Notice: Subject to any disclaimer, the term of this patent is extended or adjusted under 35 U.S.C. 154(b) by 0 days.

(21) Appl. No.: 14/211,028

(22) Filed: Mar. 14, 2014

(65) Prior Publication Data

US 2015/0040459 A1 Feb. 12, 2015

Related U.S. Application Data

(60) Provisional application No. 61/800,792, filed on Mar. 15, 2013.

(51) Int. Cl.
*F41G 1/38* (2006.01)
*F41G 1/24* (2006.01)

(52) U.S. Cl.
CPC ..... *F41G 1/24* (2013.01)

(58) Field of Classification Search
CPC ..... F41G 1/38; A47B 81/005
USPC ..... 42/122, 94, 111, 119, 124
See application file for complete search history.

(56) References Cited

U.S. PATENT DOCUMENTS

| | | | | |
|---|---|---|---|---|
| 3,477,586 | A | 11/1969 | Haluska | |
| 4,696,461 | A | 9/1987 | Zelinski | |
| 5,058,302 | A | 10/1991 | Minneman | |
| 5,617,962 | A | 4/1997 | Chen | |
| 5,755,342 | A | 5/1998 | Hoffman | |
| 5,979,846 | A | 11/1999 | Fluhr | |
| 6,935,065 | B1 | 8/2005 | Oliver | |
| 6,935,523 | B2 | 8/2005 | Ahn | |
| 7,137,511 | B1 | 11/2006 | Crowell et al. | |
| 7,467,719 | B2 | 12/2008 | Crowell et al. | |
| 7,961,381 | B2 * | 6/2011 | Pochapsky | 359/353 |
| 8,297,605 | B2 | 10/2012 | Lee et al. | |
| 8,314,994 | B1 * | 11/2012 | Thomas et al. | 359/676 |
| 8,584,394 | B1 * | 11/2013 | Thomas | 42/122 |
| 8,982,487 | B2 * | 3/2015 | Chu | 359/827 |
| 2012/0222344 | A1 | 9/2012 | Werner | |

* cited by examiner

*Primary Examiner* — Michael David
(74) *Attorney, Agent, or Firm* — Dowell & Dowell, PC

(57) ABSTRACT

A rifle scope having a body and a reticle mounted within the body, an elevation adjustment means for adjusting an elevation sighting of the reticle and including a vertically oriented elevation adjustment knob extending from a side of the body and being rotatable in a vertical plane about a horizontal axis to vertically adjust the elevation sighting of the reticle, and a windage adjustment means for adjusting the windage sighting of the retical and including a horizontally oriented windage adjustment knob extending from the body so as to be rotatable in a horizontal plane about a vertical axis to adjust the windage sighting of the reticle.

10 Claims, 3 Drawing Sheets

RIFLE SCOPE

BACKGROUND OF THE INVENTION

1. Field of the Invention

The present invention relates to a telescopic sighting device or scope for rifles and the like wherein elevation or yardage and windage adjustments to one or more reticles is facilitated to be more natural to a shooter and wherein at least one reticle is mounted within an adjustable frame, plate or tube mounted within the scope that includes elongated teeth extending both horizontally and vertically and which are engaged by elongated teeth associated with adjustment screws manipulated by yardage and windage knobs mounted to the scope.

2. Brief Description of the Related Art

Many conventional rifle scopes include both elevation or yardage and windage adjustment mechanisms that mount a elevation adjustment knob on a top of a scope and a windage adjustment knob on a side of the scope. In this manner, in order to reset one or more reticle lenses for distance, a shooter must turn the yardage knob either to the left or right. Further, to adjust for windage, the windage knob must be rotated either up or down. Such motions are contrary to the movement desired to the reticle being adjusted.

SUMMARY OF THE INVENTION

This invention is directed to a more ergonomic scope for rifles which includes at least one reticle that is adjustably mounted within a rifle scope intermediate an eyepiece and on outer objective lens. In one embodiment, the reticle is mounted within a housing that is movable vertically within a body of the scope to adjust an elevation sighting of the scope using a knob that is manually engaged from a side of the body and rotated vertically about a horizontal axis to raise and lower the housing and thus the reticle. In addition, the housing is adjustable horizontally from side-to-side within the body using a windage adjustment knob that is mounted to rotate horizontally about a vertical axis through the body.

The elevation adjustment knob and the windaged adjustment knob are positioned for optimum physical engagement by a left hand of a right handed shooter and by the right hand of a left handed shooter. That is, the knobs extend toward a shooters hand that is used to support a stock of a rifle. As the elevation knob is mounted to the side of the scope which faces the hand which normally steadies the stock of the rifle, the knob is situated to be very easily maneuvered by the fingers and thumb of the left hand, for a right handed shooter, or the right hand of a left handed shooter. Also, with the elevation knob being rotatable in a vertical plane about a horizontal axis, the relative up and down rotational movement of the knob corresponds directly to movement of the reticle in a vertical plane to raise and lower the reticle. Further, as windage adjustments require side-to-side motion of the reticle, having the windage adjustment knob positioned to rotate in a rotary motion in a horizontal plane makes physical movement of the knob more directly associated with the side-to-side horizontal motion required of the reticle.

In another embodiment of the invention, the at least one reticle is mounted within a lens support tube which extends from the eyepiece. In this embodiment, the tube extends through a housing or plate that is movable in the same manner as the previous embodiment using similarly positioned and oriented elevation and windage adjustment knobs. In both the forgoing embodiments, the knobs are each connected to adjustment screws having grooves and ridges formed therein which mesh with grooves formed both vertically and horizontally in walls of either the housing or the plate.

The reticles and the elevation and windage adjustment assemblies of the foregoing embodiments may be used in combination with more conventional elevation and windage adjustment assemblies that can be used to originally zero the rifle scope for a predetermined distance, such as between 100 to 300 yards, thereafter the reticles and adjustments therefore of the present invention may be used to adjust for actual use distances and wind speeds and direction. In addition, the scopes of the present invention may also incorporate other objective and long distance lenses that may or may not be adjustable relative to one another within the rifle scopes.

It is a primary objective of the present invention to make the elevation and windage adjustments to a reticle within a rifle scope more ergonomic than in conventional rifle scopes. The adjustment knobs for both windage and elevation are both properly positioned to be operable using the left or right hand closest to the gun stock such that the stock and the adjustment knobs may be engaged at the same time thus permitting more accurate and quick re-sighting of the scope for impact adjustments.

BRIEF DESCRIPTION OF THE DRAWINGS

A better understanding of the invention will be had with reference to the accompanying drawings wherein.

DESCRIPTION OF THE PREFERRED EMBODIMENT

Figure 1:
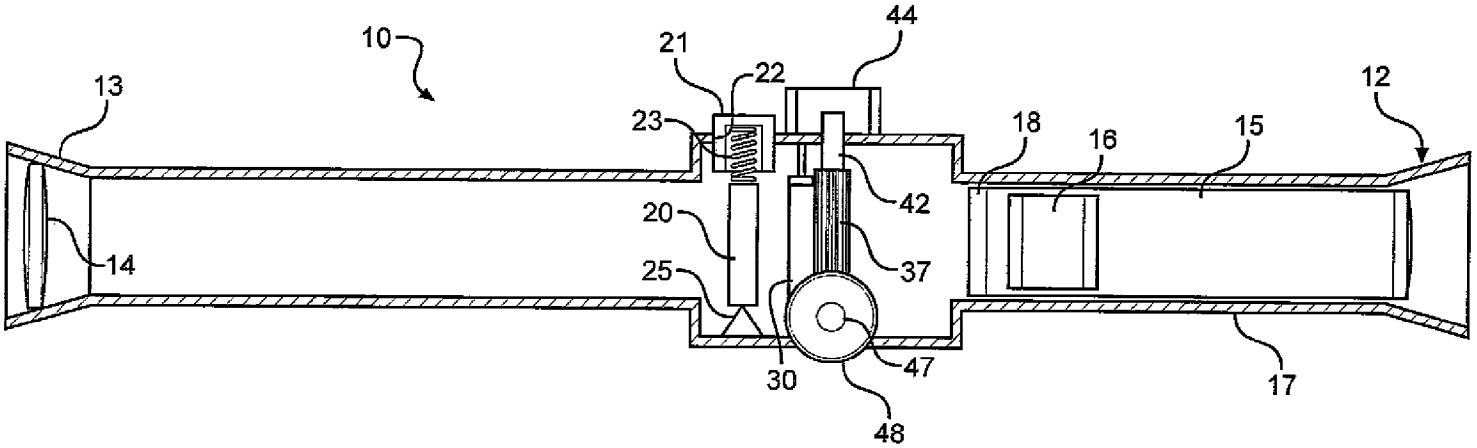
FIG. 1 is a cross section taken through a first embodiment of rifle scope in accordance with the present invention wherein the scope includes a conventional front zeroing elevation and windage adjustment for a front reticle and a rearward impact elevation and windage adjustment for adjusting a second rear reticle for currently shooting conditions.

With continued reference to the drawings, FIG. 1 is a longitudinal cross section of a scope 10 for use with substantially any conventional rifle. The scope includes an eyepiece end 12 and an objective end 13 in which an objective lens 14 is mounted. Adjacent the eyepiece is an adjustable lens mount tube 15, which in the embodiment shown, houses two spaced lenses 16 for long distance sightings. Conventionally, the tube may be rotated within an outer portion of the scope housing 17 so as to be reciprocally movable relative to a fixed lens 18 mounted further within the scope. The lens configurations for distance magnification or sighting may be substantially any configuration conventionally known.

Mounted generally centrally of the scope is a first reticle 20 which may include one or more sighting scales as are conventionally used in rifle scopes. The first reticle is adjustably mounted within the scope housing by way of conventional configured elevation and windage adjustment assemblies. Only the elevation adjustment assembly is shown in FIG. 1 and includes a elevation adjustment knob 21 and an inner screw end 23 which cooperates with a threaded opening 22 into the scope body or housing. By turning the knob 21 about a vertical axis to either the left or right, more or less force is applied against an upper edge of the reticle 20. When more force is applied downwardly on the first reticle, the first reticle is forced downwardly within the scope against a force of a resistance spring 25 which acts to apply a continuous force upwardly against the first reticle. The first reticle is used to zero the scope so as to be accurate at a predetermine range such as 100 to 300 yards. Once the scope is set to be accurate at the predetermined range, the first reticle need not be adjusted at each shooting event.

Figure 6:
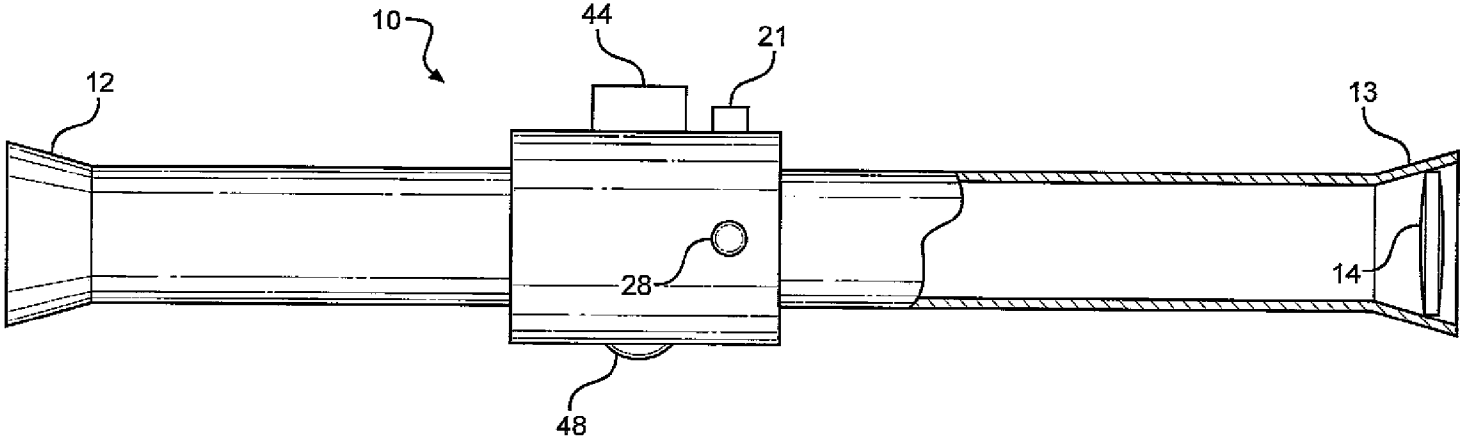
FIG. 6 is a view taken from the back side of the scope of FIG. 1 showing the conventional front windage adjustment knob for the front reticle.

In addition to the vertical adjustment to the first reticle, a windage adjustment from side-to-side of the first reticle can be done using a windage knob 28 which is connected to a windage screw shaft which is mounted through a threaded seat provide through the opposite side of the scope housing. Only the windage knob 28 is shown in FIG. 6 of the drawings. The windage screw also engages and forces the first reticle against a return spring, not shown, mounted within the scope housing to adjust a horizontal or side-to-side position of the first reticle for initial sighting or zeroing of the first reticle at the preselected range.

In accordance with the invention, a second reticle 30 is mounted to the rear of the first reticle and may also have one or more sights and/or scales or gauges thereon. A plate or housing 32 of the second reticle is movably mounted within a guide track 34 which is fixedly mounted within the central portion of the scope body or housing. The guide track includes spaced walls 35 and 36 between which the second reticle slides when being adjusted.

Figure 2:
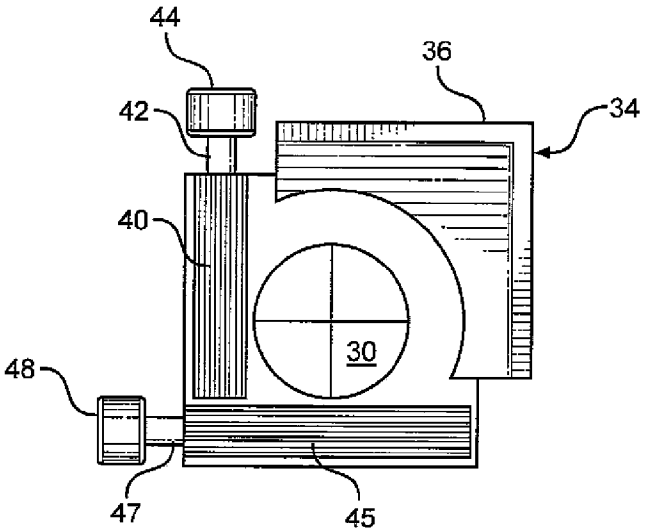
FIG. 2 is a side view of the second reticle support frame which is movably mounted within a stationary guide frame which is mounted within the scope and showing elongated teeth extending along shafts connected to both an upper mounted windage adjustment knob and a side mounted elevation adjustment knob.
Figure 3:
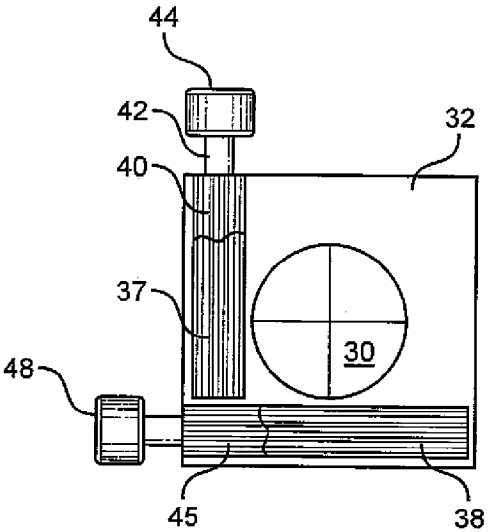
FIG. 3 is a view similar to FIG. 2 with the windage screw shaft and the elevation screw shaft removed and not showing the stationary guide frame but showing a set of horizontal grooves for meshing with the teeth of the elevation adjustment screw and a set of vertical grooves for meshing with the teeth of the windage adjustment screw.
Figure 5:
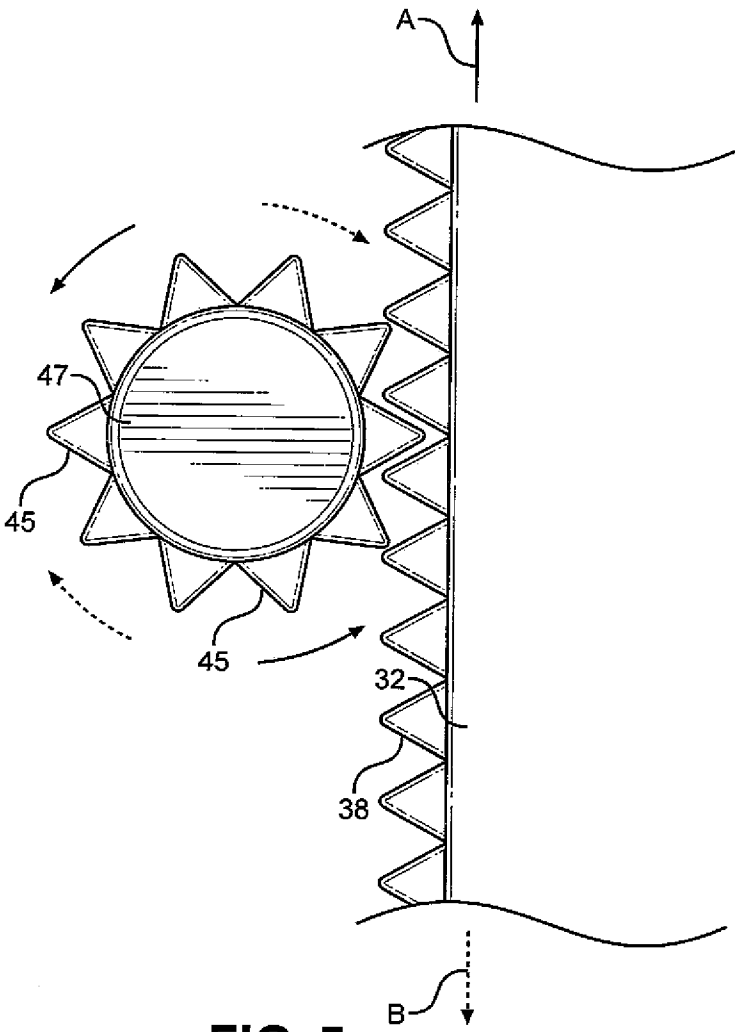
FIG. 5 is an enlarged view showing the meshed engagement of the windage screw teeth with the grooves in the second reticle plate.
Figure 4:
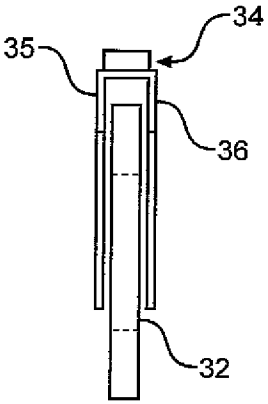
FIG. 4 is a view taken along line 4-4 of FIG. 2.

With reference to FIGS. 2, 3 and 5, the plate or housing 32 has a vertical set of horizontally spaced parallel grooves 37 formed in one face thereof and a horizontal set of vertically spaced parallel grooves 38 formed in the same face. The vertical set of grooves 37 are configured to mesh with elongated teeth 40 which extend longitudinally along a length of a shank of a windage adjustment screw 42. The screw is secured to an adjustment knob 44 which is mounted to the outer top portion of the scope housing, as shown in FIG. 1, so as to be readily manipulated by a shooters fingers and thumb of the shooters hand which is used to support the stock of a rifle. In a similar manner, the horizontal set of grooves 38 mesh with elongated teeth 45 that extend from a shank of an elevation adjustment screw 47 having an elevation adjustment knob 48.

With reference to FIG. 5, a blow up of the meshing engagement of the elevation adjustment screw teeth 45 with the parallel groves 38 is shown. By rotation of the knob 48 the teeth 45 mesh in the grooves 38 and move the second reticle upwardly or downwardly as shown by the arrows depending on the direction the knob is rotated in either an up or down direction. The arrows "A", in full line, shows movement in an upward direction and the arrows "B", in dotted line, shows movement of the reticle in a downward direction. The function of the meshing engagement of the teeth 40 of the windage screw with the vertical grooves 37 of the reticle plate 32 is the same causing the second reticle to move in a side to side motion depending on the direction of rotation of the windage knob 44. Because of the gear-like engagement between the windage adjustment screw and the elevation adjustment screw relative to the grooves on the second reticle plate, there in no need for spring mechanisms to retain the second reticle in an adjusted position.

One of the primary benefits of the present invention is that the windage adjustment knob and the elevation adjustment knob are positioned for optimum physical engagement by a left hand of a right handed shooter and by the right hand of a left handed shooter. That is, the knobs extend toward a shooters hand that is used to support the stock of the rifle. Further, as windage adjustments require side-to-side motion of the second reticle, having the windage adjust knob 44 operably to rotate in a rotary motion in a horizontal plane makes the physical movement of the knob more directly associated with the side-to-side horizontal motion required of the second reticle. Likewise, as the elevation knob 48 is mounted to the side of the scope which faces the hand which normally steadies the stock of a rifle, the knob 48 is situated to be very easily maneuvered by the fingers and thumb of the left hand, for a right handed shooter, or the right hand of a left handed shooter. Also, with the elevation knob being rotatable in a vertical plane about a horizontal axis, the relative up and down rotational movement of the knob corresponds directly to movement of the second reticle in a vertical plane to raise and lower the second reticle. Thus, depending upon whether a shooter is left or right handed, the knobs extending from either side of the scope are for adjusting elevation while knobs extending vertically from the top or bottom of the scope are for adjusting windage.

In view of the foregoing the sight adjustment devices for windage and elevation adjustment are far more ergonomic than prior art gun sights or scopes. The adjustment knobs for both windage and elevation are both properly positioned to be operable using the left or right hand closest to the gun stock such that the stock and the adjustment knobs may be engaged at the same time thus permitting more accurate and quick re-sighting of the scope for impact adjustments.

With specific reference to FIG. 6, the backside of the scope shown in FIG. 1 is shown wherein the convention windage adjustment for the front or first reticle has a knob 28 which is oriented to the right side of the scope making it difficult to adjust for a right hand shooter.

Figure 7:
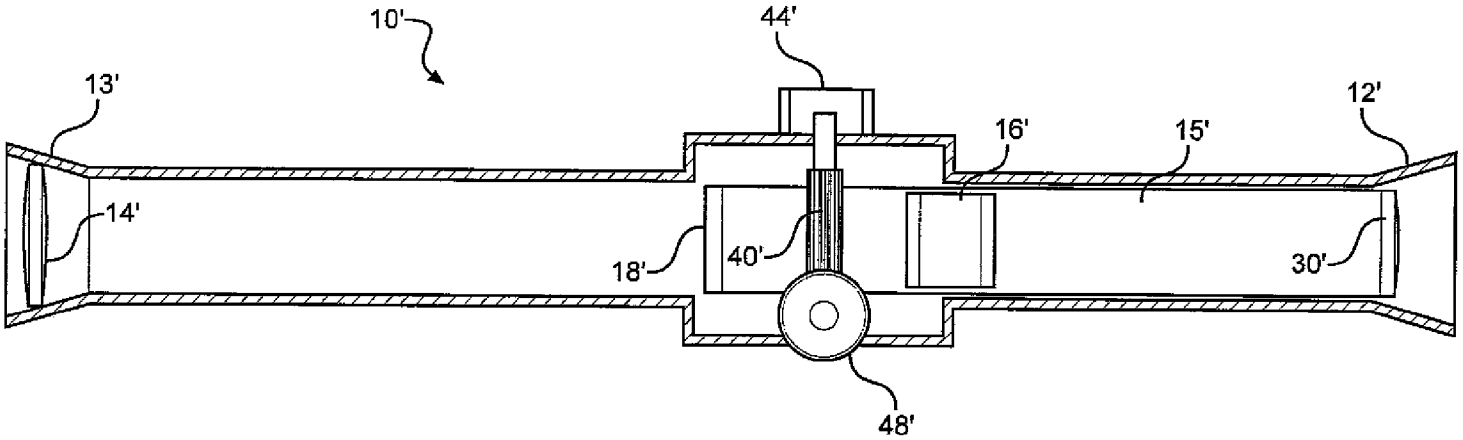
FIG. 7 is a second embodiment of scope in accordance with the invention wherein the windage knob is positioned on top of the scope and the elevation adjustment knob is positioned on a left side of the scope.

With reference to FIG. 7, a modified embodiment of the present invention is shown wherein a scope 10' includes an eyepiece end 12' and an object end 13' having an object lens 14'. This embodiment could be used with the adjustable tube structure of the embodiment of FIG. 1 or the adjustable erector lens 16' may be placed on opposite side of a single reticle from a field lens 18'. Although the single reticle may be operable in the same manner as the second reticle 30 of the embodiment of FIG. 1, the single reticle 30' may also be mounted within a tube which may also support the lenses 16' and 18'. In this embodiment, the reticle may be place at an end of the tube spaced toward the eyepiece. The tube extends through a plate 32' similar to that of plate 32 of the embodiment of FIG. 1, such that the plate has vertical and horizontal sets of grooves which mesh with elongated vertical teeth 40' of a windage adjustment screw having an adjustment knob 44' mounted at the top of the scope and horizontal teeth, not shown, of an elevation adjustment screw having an adjustment know 48'. The operating windage and elevation mechanisms are the same as the embodiment of FIG. 1 except the tube is shifted and not the reticle directly.

It should be noted that the scope could also be exactly like the embodiment of FIG. 1 but without the conventional first reticle and the conventional reticle adjustments. It should also be noted that as opposed to using the conventional windage and elevation adjustments of the embodiment of FIG. 1, the first reticle could be adjusted using another set of the windage and elevation adjustment mechanisms as used to adjust the second reticle such that both windage knobs would be accessible at the top of the scope and both elevation knobs would be accessible at the side of the scope facing a shooters free hand.

I claim:

1. A rifle scope comprising: a scope body having an eyepiece end and an objective lens end, at least one reticle mounted within the body intermediate the eyepiece and the objective lens, an elevation adjustment assembly configured for adjusting an elevation sighting of the at least one reticle and including a vertically oriented elevation adjustment knob extending from a side of the body and configured to be rotatable in a vertical plane about a horizontal axis to vertically adjust the elevation sighting of the at least one retical, and a windage adjustment assembly configured for adjusting the windage sighting of the at least one reticle and including a horizontally oriented windage adjustment knob extending from the body configured to be generally perpendicular to the elevation adjustment knob and configured to be rotatable in a horizontal plane about a vertical axis to adjust the windage sighting of the at least one reticle such that both the elevation adjustment knob and the windage adjustment knob are adjustable using a shooter's free hand which normally engages a stock of a rifle when shooting.

2. The rifle scope of claim 1 wherein the at least one reticle is carried in a housing, the housing including a plurality of vertically oriented and parallel equally spaced first grooves and a plurality of horizontally oriented and parallel equally spaced second grooves, the elevation adjustment assembly includes a first adjustment screw operably connected to the elevation adjustment knob wherein the first adjustment screw has a plurality of parallel teeth that mesh with the first grooves so that by rotation of the elevation adjustment knob, the housing is vertically adjustable within the body of the scope, and the windage adjustment assembly includes a second adjustment screw operably connected to the windage adjustment knob wherein the second adjustment screw has a plurality of parallel teeth that mesh with the second grooves so that by rotation of the windage adjustment knob, the housing is horizontally adjustable within the body of the scope.

3. The rifle scope of claim 2 wherein a zeroing reticle is adjustably mounted within the body in spaced relationship to the at least one reticle.

4. The rifle scope of claim 3 wherein the zeroing reticle is engaged by a first shaft extending from a zeroing elevation adjustment knob so as to be vertically movable within the body against a force of a first biasing spring and wherein the zeroing reticle is engaged by a second shaft of a zeroing windage adjustment knob so as to be horizontally movable in a side-to-side motion within the body against a forced of a second biasing spring.

5. The rifle scope of claim 4 wherein the first shaft is adjustable within a first threaded opening in the body and the second shaft is adjustable within a second threaded opening in a side wall of the body and which second threaded opening is oriented generally perpendicular with respect to the first threaded opening.

6. The rifle scope of claim 4 wherein the zeroing reticle is intermediate the at least one reticle and the objective lens end of the body.

7. The rifle scope of claim 1 wherein the at least one reticle is mounted within a tube mounted within the body, the tube extending through a plate so as be adjustably movable with the plate, the plate including a plurality of vertically oriented and parallel equally spaced first grooves and a plurality of horizontally oriented and parallel equally spaced second grooves, the elevation adjustment assembly including a first adjustment screw operably connected to the elevation adjustment knob wherein the first adjustment screw has a plurality of parallel teeth that mesh with the first grooves so that by rotation of the elevation adjustment knob, the plate is vertically adjustable within the body of the scope, and the windage adjustment assembly includes a second adjustment screw operably connected to the windage adjustment knob wherein the second adjustment screw has a plurality of parallel teeth that mesh with the second grooves so that by rotation of the windage adjustment knob, the plate is horizontally adjustable within the body of the scope.

8. The rifle scope of claim 7 including an erector lens mounted within the tube between the eyepiece and the at least one reticle and a field lens mounted within the tube on an opposite side of the at least one reticle from the erector lens.

9. The rifle scope of claim 1 wherein including an adjustable lens mounting tube mounted between the eyepiece and the at least one reticle, spaced lenses mounted within the tube so as to be rotationally adjusted relative to a fixed lens mounted between the at least one reticle and the adjustable tube.

10. The rifle scope of claim 2 wherein including an adjustable lens mounting tube mounted between the eyepiece and the at least one reticle, spaced lenses mounted within the tube so as to be rotationally adjusted relative to a fixed lens mounted between the at least one reticle and the adjustable tube.

* * * * *